US010251464B2

(12) United States Patent
Seuk

(10) Patent No.: US 10,251,464 B2
(45) Date of Patent: Apr. 9, 2019

(54) FOLD-OUT BACKPACK

(71) Applicant: Jo Won Seuk, Fayetteville, NC (US)

(72) Inventor: Jo Won Seuk, Fayetteville, NC (US)

( * ) Notice: Subject to any disclaimer, the term of this patent is extended or adjusted under 35 U.S.C. 154(b) by 213 days.

(21) Appl. No.: 15/197,295

(22) Filed: Jun. 29, 2016

(65) Prior Publication Data

US 2017/0000243 A1 Jan. 5, 2017

Related U.S. Application Data

(60) Provisional application No. 62/186,994, filed on Jun. 30, 2015.

(51) Int. Cl.

| | |
|---|---|
| ***A45F 3/04*** | (2006.01) |
| ***A45F 4/02*** | (2006.01) |
| ***A45F 4/06*** | (2006.01) |
| ***A45F 4/08*** | (2006.01) |

(52) U.S. Cl.

CPC ..... *A45F 3/04* (2013.01); *A45F 4/02* (2013.01); *A45F 4/06* (2013.01); *A45F 4/08* (2013.01)

(58) Field of Classification Search

CPC .. A45F 3/04; A45F 3/042; A45F 3/047; A45F 3/06; A45F 3/08; A45F 3/10; A45F 3/12; A45F 2003/045; A45F 4/00; A45F 4/02; A45F 4/06; A45F 2004/023; A45F 2004/026

USPC ..... 224/153, 155, 583, 634, 649, 680, 684

See application file for complete search history.

(56) References Cited

U.S. PATENT DOCUMENTS

| | | | | |
|---|---|---|---|---|
| 2,324,194 | A * | 7/1943 | Campiglia | A61F 17/00 206/570 |
| 4,609,084 | A * | 9/1986 | Thomas | A45C 9/00 190/110 |
| 5,641,199 | A * | 6/1997 | Bond-Madsen | A45F 4/02 224/153 |
| 6,112,959 | A * | 9/2000 | Townsend | A45F 3/04 224/153 |
| 6,193,118 | B1 * | 2/2001 | Kearl | A45C 7/0095 108/43 |
| 7,600,619 | B2 * | 10/2009 | Sapyta | A45C 7/0054 190/107 |
| 9,700,124 | B2 * | 7/2017 | Coleman | A45F 4/02 |
| 2002/0092882 | A1 * | 7/2002 | Jones | A45C 7/0059 224/645 |
| 2008/0029562 | A1 * | 2/2008 | Hawkins | A45F 3/04 224/153 |
| 2012/0132066 | A1 * | 5/2012 | Seuk | F41H 1/02 89/36.05 |
| 2015/0366332 | A1 * | 12/2015 | Marji | A45F 3/04 224/583 |

* cited by examiner

*Primary Examiner* — Scott T McNurlen

(57) ABSTRACT

The backpack has a main body that unfolds to lie flat providing ready access to the contents of the pack and various separate accessory pouches carried within the main body of the pack. The main body of the backpack is formed by a flat back panel, a pair of flat side panels and a top panel. The side panels and the top panel are integrally connected to the back panel and fold together to fashion the main body of the backpack in a folded orientation and unfold to lie flat side-by-side in an unfolded orientation. The panels are adapted to selectively support a variety of detachable accessory pouches. They provide compartment for stowing items to be carried in the backpack.

16 Claims, 3 Drawing Sheets

FOLD-OUT BACKPACK

This application claims the benefit of U.S. Provisional Application No. 62/186,994 filed Jun. 30, 2015, the disclosure of which is hereby incorporated by reference.

This invention relates to backpacks and in particular a backpack that folds out to lie flat when doffed to provide ready access to internal pouches and compartments.

BACKGROUND AND SUMMARY OF THE INVENTION

Backpacks are commonly used to carry items. In its simplest form, a backpack generally consist of a cloth sack carried on one's back and secured with two straps that go over the shoulders. Most often, the majority of items carried in backpacks are stowed within the interior of the pack, that is within the cloth sack or pack body. While backpacks are available in a variety of sizes, shapes and configurations, the conventional backpack designs heretofore maintain the basic sack configurations where items stowed within the pack interior are only accessible through openings in the pack body.

The backpack of this invention has a main body that unfolds to lie flat providing ready access to the contents of the pack and various separate accessory pouches carried within the main body of the pack. The main body of the backpack is formed by a flat back panel, a pair of flat side panels and a top panel. The side panels and the top panel are integrally connected to the back panel and fold together to fashion the main body of the backpack in a folded orientation and unfold to lie flat side-by-side in an unfolded orientation. The panels are adapted to selectively support a variety of detachable accessory pouches for stowing items to be carried in the backpack.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
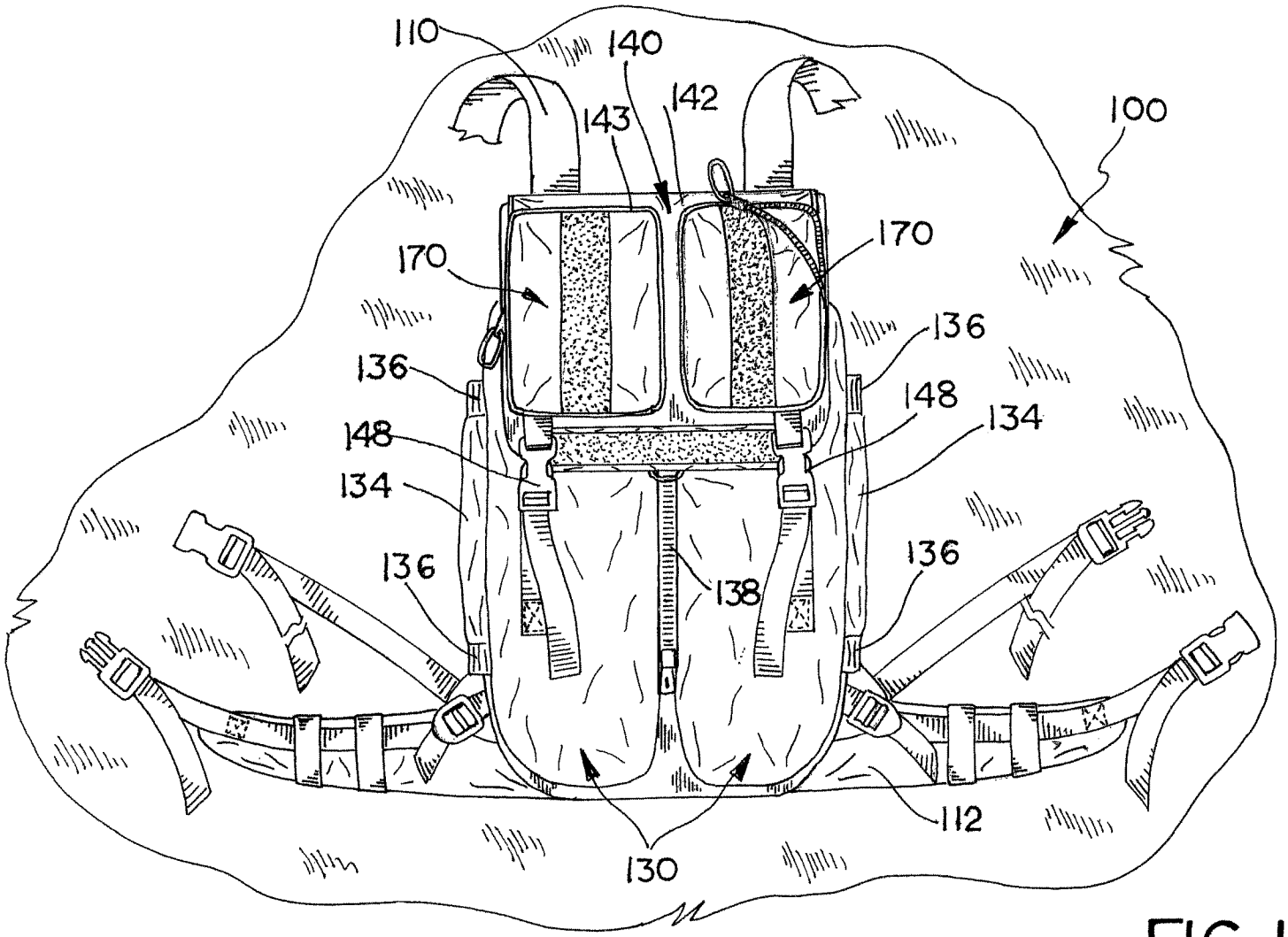
FIG. 1 is a top view of an exemplary embodiment of the backpack of this invention lying on the ground in an unfolded position.
Figure 2:
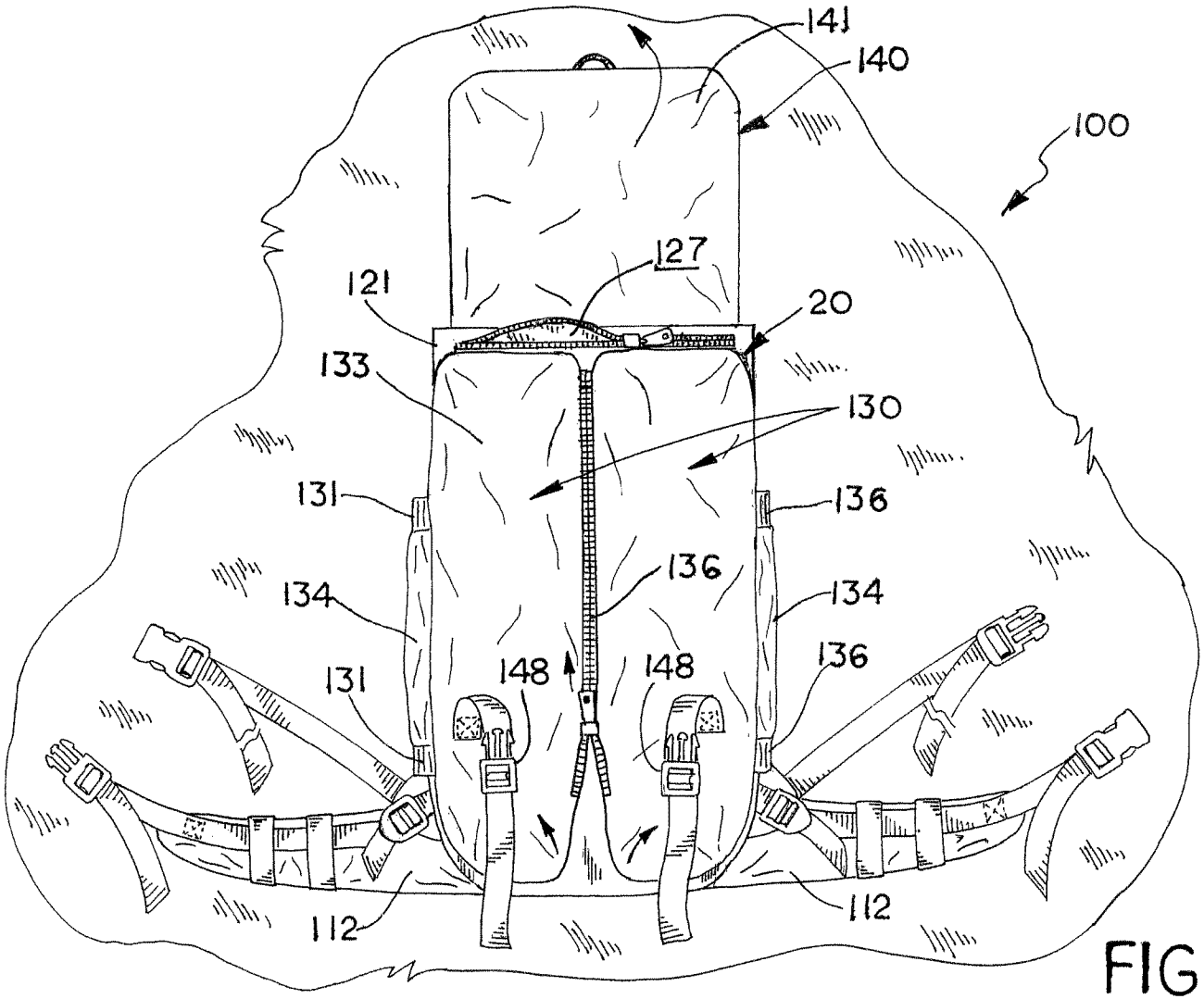
FIG. 2 is a top view of the backpack of FIG. 1 lying on the ground with the top panel unfolded.
Figure 3:
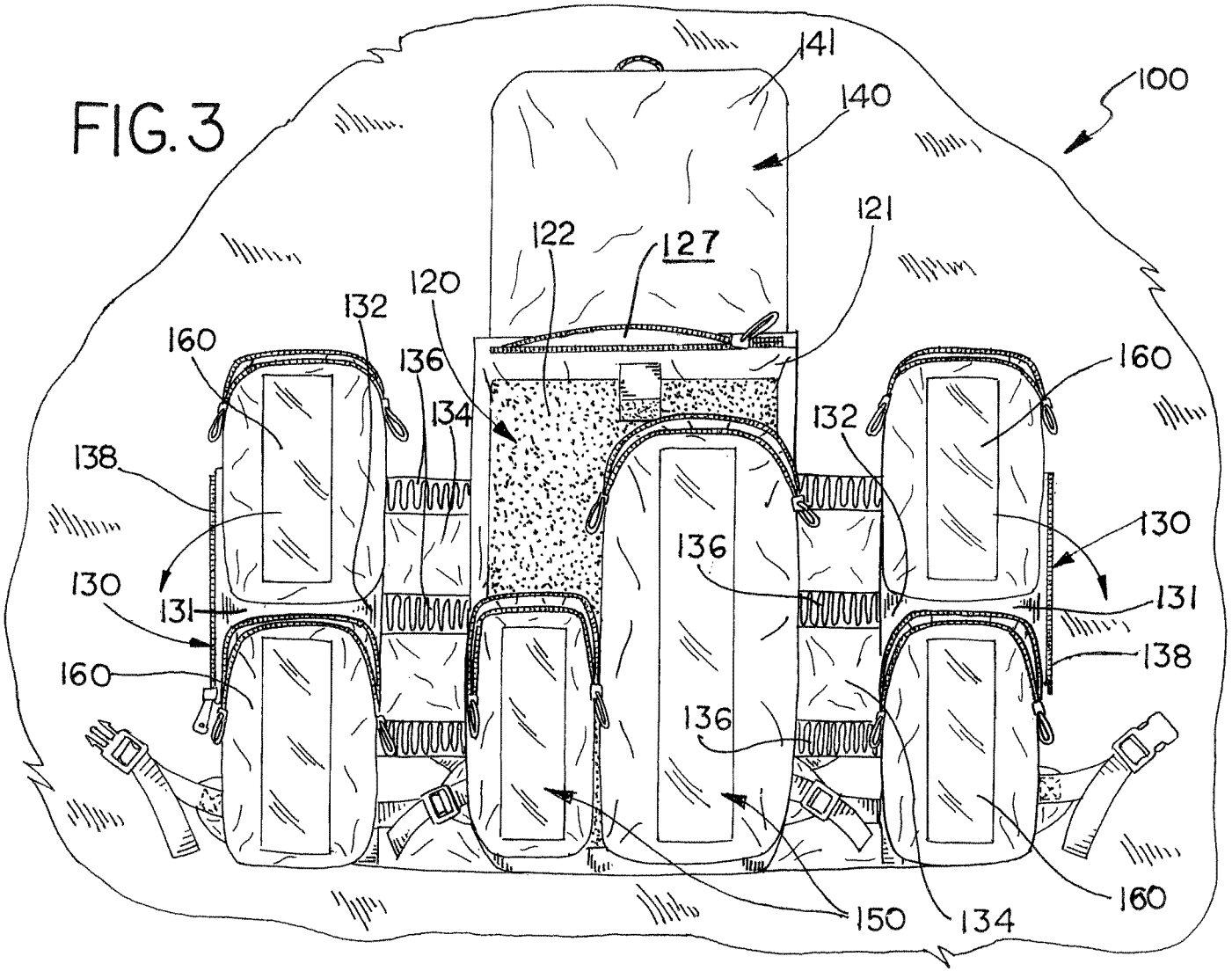
FIG. 3 is a top view of the backpack of FIG. 1 lying on the ground with the top panel and side panels unfolded.

Referring now to the drawings, FIGS. 1-3 show an exemplary embodiment of the backpack of this invention, which is designated generally as reference numeral 100. Backpack 100 is made from traditional materials using conventional construction techniques common in the industry. The panels and section that form the body of backpack 100 are ideally made of durable, light-weight nylon fabrics, or of other suitable cloths and fabrics that resist tears, abrasions and scuffs as desired. Backpack 100 includes shoulder straps 110 and a waist belt 112. In other embodiments, the backpacks may not have a waist belt or may have removable shoulder straps and waist belt, which are common in the art. Backpack 100 also includes a variety of straps, webbing, adjustment slides and quick connect buckles and fasteners. These are also common features and components in conventional backpacks.

As shown, backpack 100 includes an un-foldable main body that is formed by a flat back panel 120, a pair of flat side panels 130 and a top panel 140. Back panel 120 and side panels 130 form a folding substructure for supporting internally carried items along with affixed and detachable internal pouches. Side panels 130 and top panel 140 are integrally connected to back panel 120 and fold together to fashion the body of the backpack in a folded orientation (FIG. 1) and unfold to lie flat side-by-side in an unfolded orientation (FIG. 3). In the folded orientation, side panels 130 are manually folded in over the back panel 120 enveloping any internally carried items and pouches within the pack body. In the unfolded orientation, side panels 130 are manually laid open flat on ground to provide access to the items and pouches.

Back panel 120 has a zippered internal pocket 127 for stowing maps and other documents. Side panels 130 have intermediate "connection" sections 134 that are sewn to back panel 120. Three elastic straps 136 are sewn laterally across connection sections 134, which allow the main body of backpack 100 to expand and contract in the interior of the main body of the backpack when in the folded orientation. As shown in FIGS. 2 and 3, side panels 130 fold inward to overlie back panel 120. A zipper 138 connects opposed edges of side panels 130 when backpack 100 is in the folded orientation. Top panel 140 folds to overlie side panels 130 and back panel 120 when the backpack is in the folded orientation. Quick release connectors and straps 148 are used to secure top panel 140 to side panels 130 and hold the main body of backpack 100 in the folded orientation.

Panels 120, 130 and 140 are adapted to selectively support a variety of detachable pouches 150, 160 and 170. The pouches provide compartments for stowing items to be carried in backpack 100. The pouches are of conventional design and construction, and may take any size, shape or configuration as desired. Typically, the pouches having a fabric body and a zippered opening. In backpack 100, pouches 150 are fitted to the inner face 121 of back panel 120, pouches 160 are fitted to the inner face 131 of side panels 130 and pouches 170 are fitted to the outer face of top panel 140.

Pouches 150, 160 and 170 are detachably fitted to panels 120, 130 and 140 respectively using the interconnection of mating patches or sections of hook and loop materials sewn or bonded to the pouches and the panels. The interconnection using hook and loop materials, such as Velcro® from Velcro Industries, B.V., allows the pouches to be selectively positioned and arranged at any desired position on the panels, as well as, allowing each individual pouch to be quickly attached and detached from the panels. The inner face 122 of back panel 120 is covered with a large section of hook and loop material (not shown), which is intended to mate with corresponding sections of hook and loop material (not shown) on the backs of pouches 150. Similarly, the inner faces 132 of side panels 130 are covered with a large section of hook and loop material (not shown), which is intended to mate with corresponding sections of hook and loop material (not shown) on the backs of pouches 160. The outer face 143 of top panel 140 is covered with a large section of hook and loop material (not shown), which is intended to mate with a corresponding section of hook and loop material (not shown) on the backs of pouches 170.

In other embodiments, the pouches may be detachably fitted to the panels using other modular attachment methods, such as PALS (Pouch Attachment Ladder System) webbing and similar connection interfaces for MOLLE (Modular Lightweight Load-carrying Equipment) compatible pouches. PALS interface allows MOLLE compatible pouches to be detachably secured to the panel using specialized connectors, such as MALICE Clips® from Tactical Tailor (not shown). Typically, the PALS interface consists of a number of spaced horizontal rows of heavy-duty 1" nylon webbing sewn to each of the panels, which form a lattice to which individual pouches are secured. PALS webbing connection interfaces are well known and commonly used attaching components and accessories to load bearing equipment in military and law enforcement applications, particularly for backpacks, chest rigs and tactical vests. In other embodiments, the PALS interface may take the form of slits cut or formed in the outer covering of the panels that are arranged in a lattice of spaced rows and columns in a similar configuration to that of the lattice of webbing.

In use, backpack 100 is laid on the ground in the unfolded orientation with the panels lying open side-by-side (FIG. 3). Pouches 150, 160 and 170 and backpack 100 are selectively arranged and fitted to panels 120, 130 and 140. Once the pouches are fitted to the panels, items may be loaded into the pouches and/or affixed to the panels and the pack loaded as desired. Once loaded, side panels 130 are folded inward and secured using zipper 138 (FIG. 2). Next, top panel 140 is folded down over side panels 130 and secured using strap connector 148 (FIG. 1). With backpack 100 in the folded orientation, pouches 150, 160 and 170 are enveloped by the substructure and enclosed within the body of the pack. Once in the folded orientation, backpack 100 functions as any conventional pack and can be donned by a user to transport the items. To access the items, backpack 100 is doffed and laid on the ground. Side panels 130 and top panel 140 are unfolded providing visibility and direct access to all pouches 150, 160 and 170 and their contents.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A backpack comprising:

a pack body; and shoulder straps connected to the pack body, the pack body having a back wall panel, side wall panels integrally connected to the back wall panel and a top wall panel integrally connected to the back wall panel, each of the back wall panel, the side wall panels and the top wall panel are adapted to support a plurality of pouches connected thereto and to fold in a first orientation so that the back wall panel, the side wall panels and top wall panel overlap each other to define an enclosed pack body interior and unfold in a second orientation so that the back wall panel, the side wall panels and the top panel lie flat and side by side to each other, the pack body also having intermediate connection sections connecting the side wall panels to the back panel, each of the intermediate connection sections includes elastic straps affixed laterally across the intermediate connection section, which allows the enclosed pack body interior to expand and retract when the pack body is folded in the first orientation.

2. The backpack of claim 1 wherein each of the back wall panel, the side wall panels and the top wall panel have a first surface and a second surface, the first surface of each of the back wall panel, the side wall panels and the top wall panel having an interconnection means for detachably connecting one of the plurality of pouches thereto such that the ones of the plurality of pouches are spaced together and enclosed within the pack body in the first orientation and spaced apart in the second orientation.

3. The backpack of claim 2 wherein the second surface of the side wall panels and the top wall panel having an interconnection means for detachably connecting others of the plurality of pouches thereto.

4. The backpack of claim 3 wherein the interconnection means is mating sections of hook and loop material.

5. The backpack of claim 3 wherein the interconnection means is a MOLLE compatible interface.

6. The backpack of claim 1 wherein the side wall panels each include a first mating connector adapted to secure the side wall panels together when folded in the first orientation.

7. The backpack of claim 6 wherein the first mating connector is a zipper part.

8. The backpack of claim 1 wherein the side wall panels and the top wall panel each include a second mating connector adapted to secure the top wall panel and the side wall panels together when folded in the first orientation.

9. The backpack of claim 8 wherein the second mating connector is a buckle part.

10. The backpack of claim 1 and a waist belt connected to the pack body.

11. The backpack of claim 10 where the substructure also includes a top wall panel integrally connected to the back wall panel, the top wall panel is manually folded in and over the back wall panel when the substructure is in the first orientation and manually laid open flat adjacent the back wall panel in the second orientation.

12. The backpack of claim 11 wherein each of the side wall panels and the top wall panel include a second mating connector adapted to secure the top wall panel and the side wall panels together when folded in the first orientation.

13. The backpack of claim 10 wherein each of the side wall panels includes a first mating connector adapted to secure the side wall panels together when folded in the first orientation.

14. The backpack of claim 13 wherein the first mating connector is a zipper part.

15. A backpack comprising:

a pack body; and shoulder straps connected to the pack body, the pack body has a substructure for supporting carried items and pouches, the substructure includes a back wall panel, a pair of side wall panels integrally connected to the back wall panel opposite each other, the substructure folds and unfolds between a first orientation where the pair of side panels are manually folded in and over the back panel to define an enclosed pack body interior and envelop any internally carried items and pouches within the pack body and a second orientation where the side panels and back wall panel are manually laid open flat with the side panels laid adjacent the back wall panel to provide access to the items and pouches, each of the back wall panel and the pair of side wall panels having a first surface adapted to support and detachably affix thereto the internally carried items and pouches such that the internally carried items and pouches are enveloped by the substructure when folded in the first orientation, the substructure also includes intermediate connection sections connecting the side wall panels to the back panel, each of the intermediate connection sections includes elastic straps affixed laterally across the intermediate connection section, which allows the enclosed pack body interior to expand and contract when the pack body is folded in the first orientation.

16. The backpack of claim 15 wherein each of the back wall panel and the pair of side wall panels have a second surface, the second surface having an interconnection means for detachably connecting others of the plurality of pouches thereto.

* * * * *